US005322736A

United States Patent [19]

Boyle et al.

[11] Patent Number: 5,322,736

[45] Date of Patent: Jun. 21, 1994

[54] HOLLOW-TRILOBAL CROSS-SECTION FILAMENTS

[75] Inventors: John B. Boyle, Midlothian; Weldon H. Peterson, Colonial Heights, both of Va.

[73] Assignee: AlliedSignal Inc., Morris Township, Morris County, N.J.

[21] Appl. No.: 80,640

[22] Filed: Jun. 24, 1993

[51] Int. Cl.[5] ..... D02G 3/00

[52] U.S. Cl. ..... 428/397; 428/398; 428/92; 428/97; 428/373; 428/374; 264/171

[58] Field of Search ..... 428/376, 397, 398, 92, 428/97; 264/171

[56] References Cited

U.S. PATENT DOCUMENTS

| | | | |
|---|---|---|---|
| 2,476,293 | 7/1949 | Hall et al. | 428/398 |
| 2,939,201 | 6/1960 | Holland | 28/82 |
| 3,095,258 | 6/1963 | Scott | 264/177 |
| 3,493,459 | 2/1970 | McIntosh et al. | 161/178 |
| 3,745,061 | 7/1973 | Champaneria et al. | 161/178 |
| 4,001,369 | 1/1977 | Shah | 264/177 |
| 4,279,053 | 7/1981 | Payne et al. | 428/398 |
| 4,364,996 | 12/1982 | Sugiyama | 428/369 |
| 4,407,889 | 10/1983 | Gintis et al. | 428/398 |
| 4,492,731 | 1/1985 | Bankar et al. | 428/362 |
| 4,621,022 | 11/1986 | Kohaut et al. | 428/398 |
| 4,648,830 | 3/1987 | Peterson et al. | 425/464 |
| 4,770,938 | 9/1988 | Peterson et al. | 428/398 |
| 4,956,237 | 9/1990 | Samuelson | 428/376 |
| 5,108,838 | 4/1992 | Tung | 428/357 |
| 5,125,818 | 6/1992 | Yeh | 428/398 |
| 5,208,106 | 5/1993 | Tung | 428/92 |
| 5,208,107 | 5/1993 | Yeh et al. | 428/397 |

FOREIGN PATENT DOCUMENTS 0516119 5/1992 European Pat. Off. .

*Primary Examiner*—Patrick J. Ryan
*Assistant Examiner*—N. Edwards
*Attorney, Agent, or Firm*—Wayne W. Rupert

[57] ABSTRACT

This invention relates to a trilobal filament having at least one axially extending void, preferably one axially extending void in each lobe, wherein each lobe has a composite curve profile having a first arm angle $\alpha$ and a second arm angle $\beta$, the cross-section has a modification ratio of 2.4 to 5.0, and the total cross-sectional area is 5 to 15 percent void. In a further aspect, this invention is a spinnerette for producing a filament comprising at least one bore group, wherein the bore group has three legs divergent from each other by 130° to 150° and each leg includes two substantially parallel capillary sections and one nipple capillary section which extends to the outermost point of each leg.

9 Claims, 14 Drawing Sheets

HOLLOW-TRILOBAL CROSS-SECTION FILAMENTS

BACKGROUND OF THE INVENTION

This invention relates to a hollow trilobal cross-section filament for use as carpet yarn, and to a spinnerette for its manufacture.

Trilobal filaments with at least one axially extending hole are described in U.S. Pat. Nos. 3,493,459, 4,001,369, 4,648,830 and 4,770,938. U.S. Pat. No. 4,770,938 describes a trilobal filament having an axially extending hole in each lobe. The total cross-sectional area of the filament is 5 to 12 percent void, the filament cross-section has a modification ratio of 2 to 3 and an arm angle of 15° to 45°. U.S. Pat. No. 3,493,459 describes a trilobal filament having an axially extending hole at the center of the filament and smaller axially extending holes in each lobe.

Although the prior art hollow filaments are said to provide improved sparkle or luster and bulk when used as a carpet yarn, there exists a need for further improvement in these properties. In addition, it would be advantageous if hollow filaments could improve the cover of carpet yarns.

SUMMARY OF THE INVENTION

It is therefore an object of this invention to provide a filament which has improved bulk, luster and cover. In accomplishing this object there is provided according to one aspect of this invention a trilobal filament having at least one axially extending void, preferably one axially extending void in each lobe, wherein each lobe has a composite curve profile having a first arm angle $\alpha$ and a second arm angle $\beta$, the cross-section has a modification ratio of 2.4 to 5.0, and the total cross-sectional area is 5 to 15 percent void. This filament preferably is used in carpet yarn.

In a further aspect, this invention is a spinnerette for producing a filament comprising at least one bore group, wherein the bore group has three legs divergent from each other by 130° to 150° and each leg includes two substantially parallel capillary sections and one nipple capillary section which extends to the outermost point of each leg.

Further objects, features and advantages of the invention will become apparent from the detailed description of preferred embodiments that follows.

BRIEF DESCRIPTION OF THE DRAWING

The invention will be described below in more detail with reference to the drawing, wherein.

DETAILED DESCRIPTION OF THE PREFERRED EMBODIMENTS

As used herein, "filament" includes a polymer or copolymer which has been formed into an article of a running or extremely long length and which is known conventionally as a continuous filament, or a polymer or copolymer which has been formed into an article of a running or extremely long length and then cut or chopped into shorter lengths, which is known conventionally as staple.

The type of polymer or copolymer from which the filament is made can be any type typically used for carpet or upholstery yarn. Illustrative of such types are polyamide, polyester, polyolefin (especially polypropylene) and acrylic.

"Polyamide" denotes nylon 6, nylon 66, nylon 4, nylon 12 and other polymers containing the $$(\underset{\underset{O}{\|}}{C}-NH)$$

structure along with the $(CH_2)_x$ chain as described in Cook, J., *Handbook of Textile Fibres,* Merrow Publishing Co., pp. 194–327 (1984). Nylon 6 and nylon 66 are preferred.

"Polyester⇄ denotes polyethylene terephthalate (PET), polybutylene terephthalate (PBT), polyethylene naphthalate (PEN), polyalkylene adipate, polyesters of dyhydric phenols, liquid crystal polymers and other polymers containing the $$(-\underset{\underset{O}{\|}}{C}-O-)$$

repeating unit as described in *Encyclopedia of Polymer Science and Engineering,* Vol. 12, pub. by John Wiley & Sons, Inc., pp. 1–300 (2ed. 1989). PET is preferred.

Figure 1:
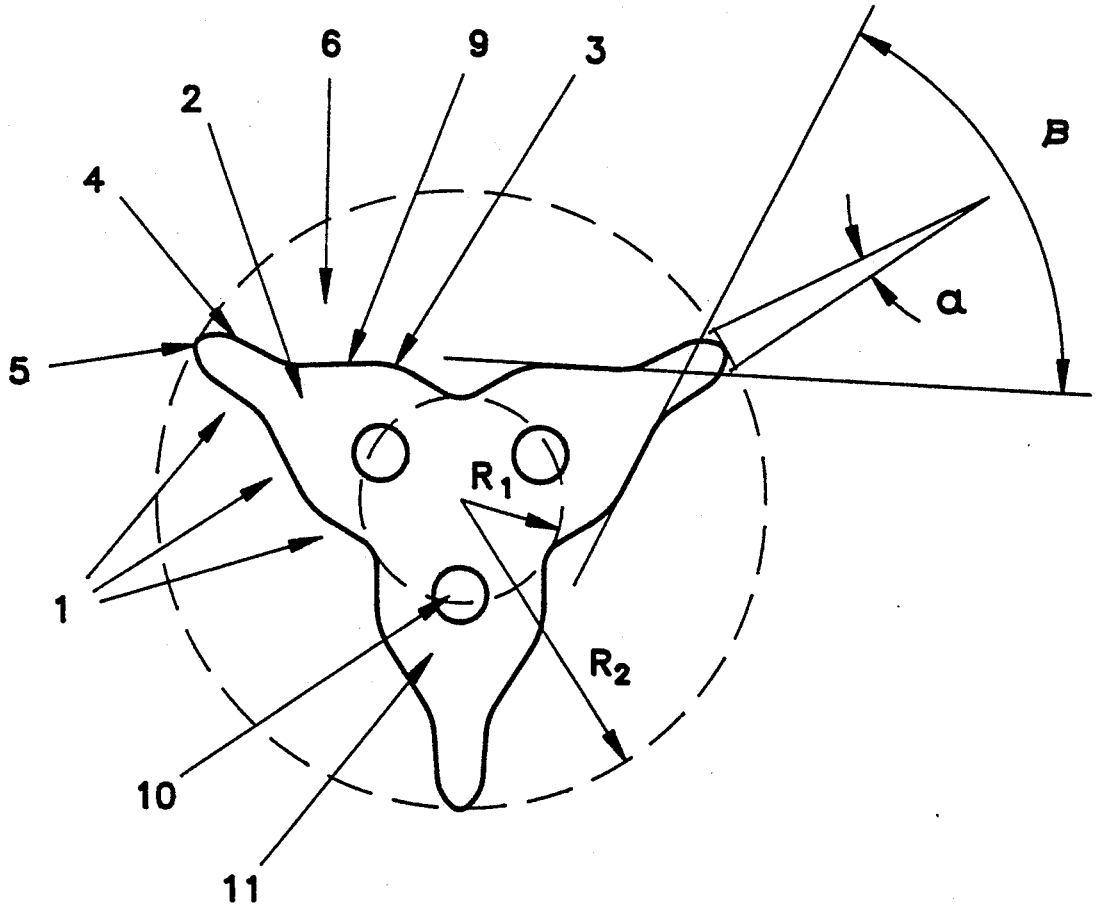
FIGS. 1–3 are cross-sectional views of three different embodiments of the filament of the invention.
Figure 4:
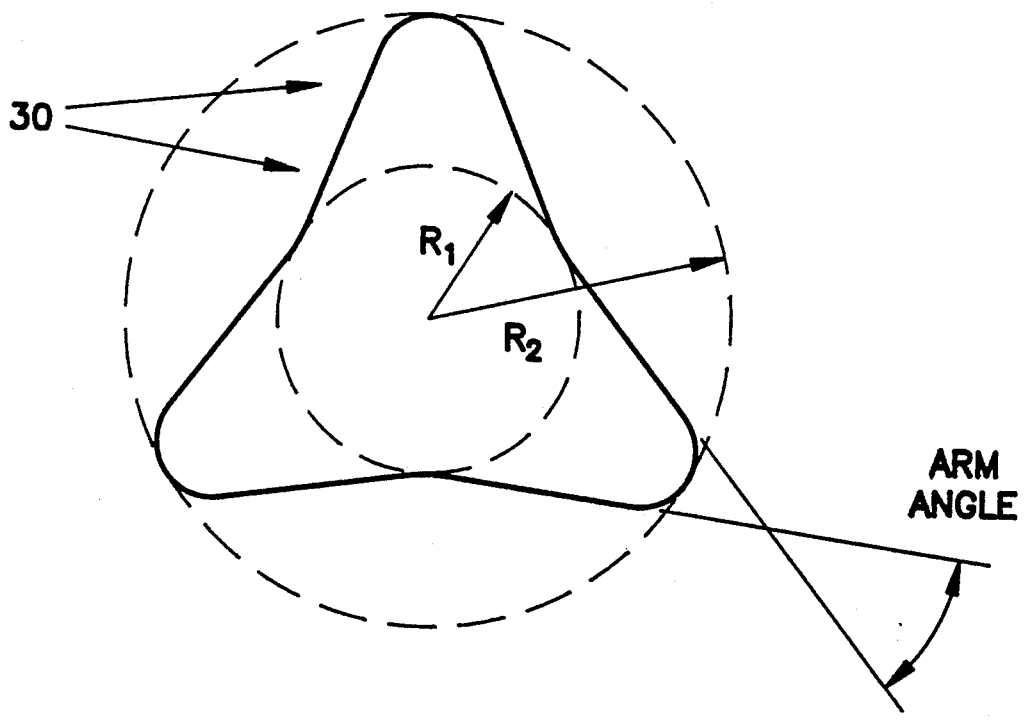
FIG. 4 (PRIOR ART)
FIG. 4 is a cross-sectional view of a prior art trilobal filament.

"Modification ratio" is a well known measure of the cross-section of a trilobal filament and is defined, for example, in U.S. Pat. No 4,492,731, incorporated herein by reference, and Patent No. EP-A-0 516,119. As shown in FIGS. 1 and 4, "modification ratio" means the ratio of the radius $R_2$ of the circumscribed circle to the radius $R_1$ of the inscribed circle. The cross-section of the filament of the invention has a modification ratio of 2.4 to 5.0, preferably at least 3.0, and more preferably 3.0 to 4.5.

Figure 2:
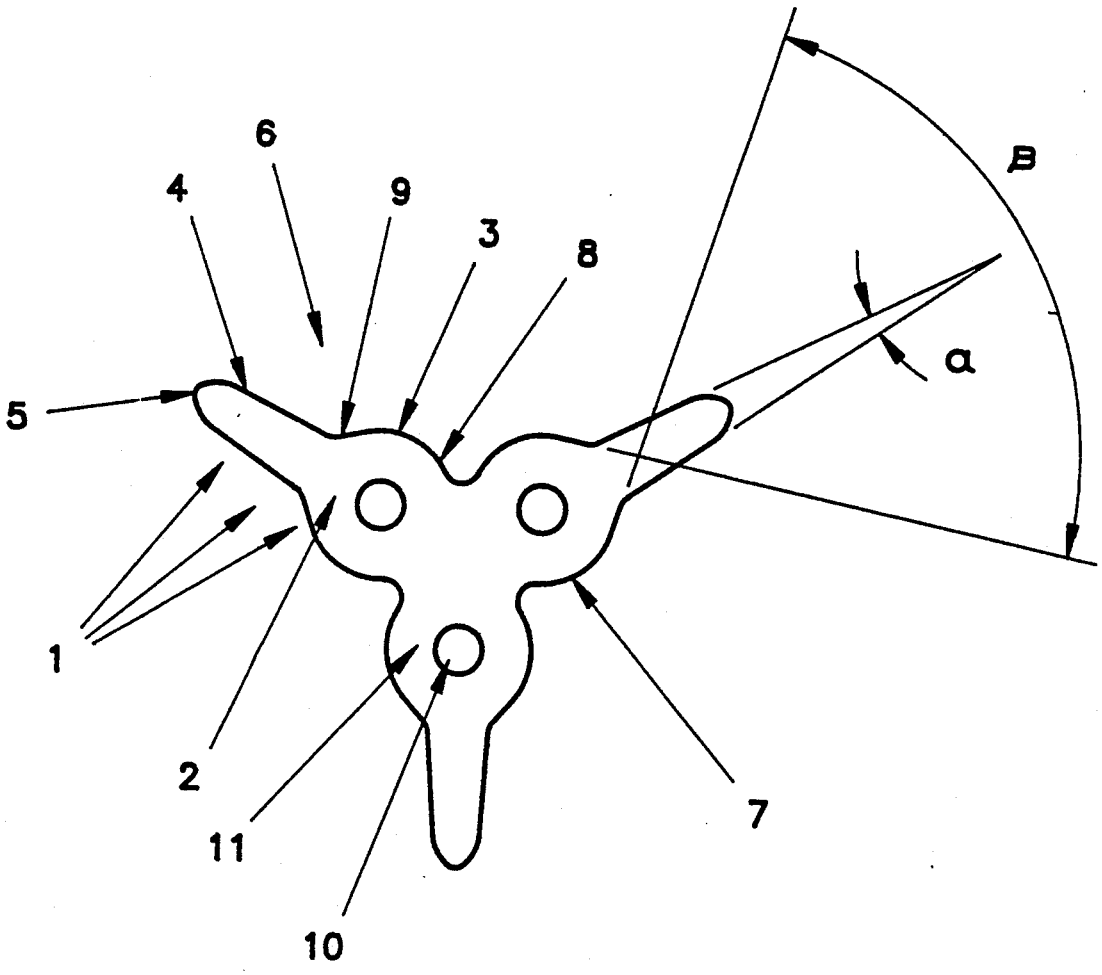
Figure 3:
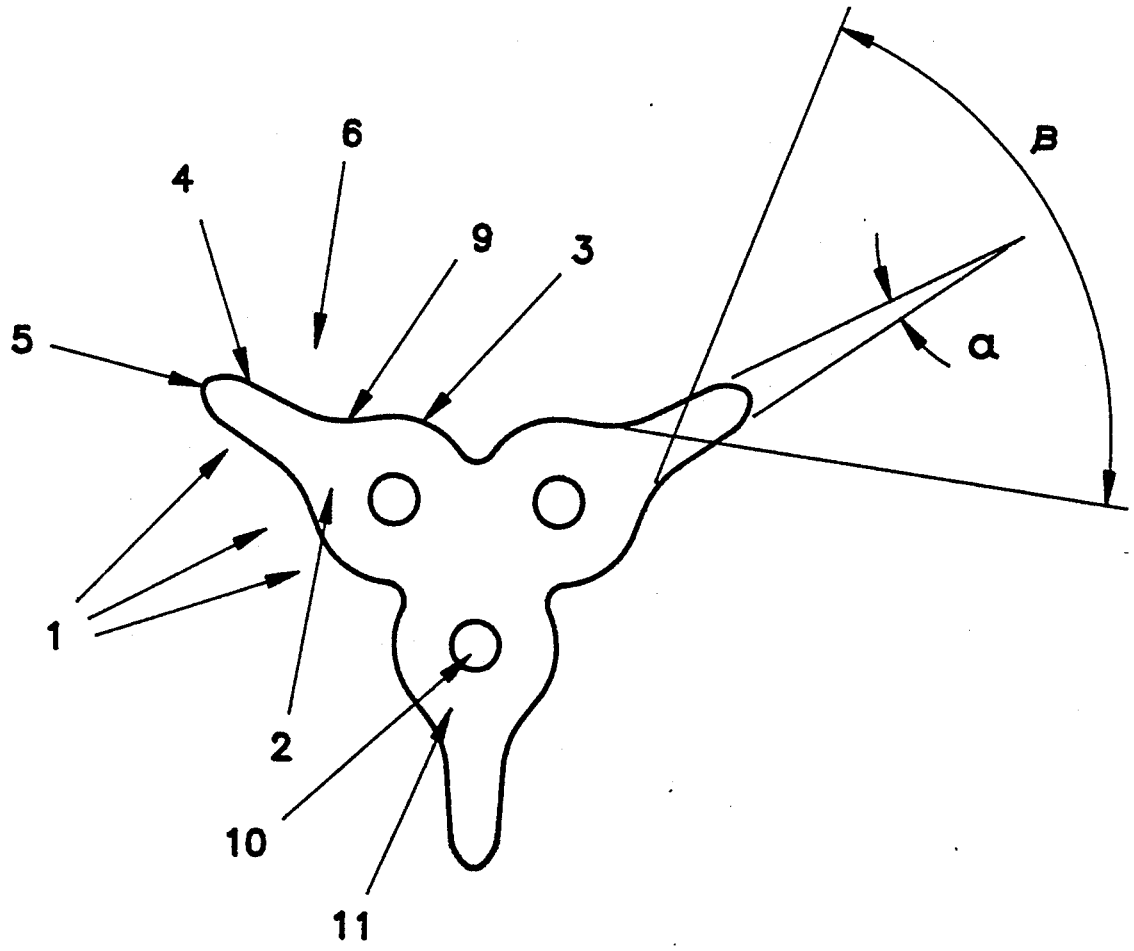

Exemplified embodiments of the filament of the invention are shown in FIGS. 1 to 3. A unique feature is the composite curve profile 1 of the outwardly extending surface of each lobe 2. By "composite curve" is meant a continuous line which follows a path that includes two sections—a parabolic or elliptical-shaped section 3 and a nipple-shaped section 4. Conventional trilobal filaments as shown in FIG. 4 have essentially straight profiles 30 extending outwardly and tangentially to the inscribed circle.

The parabolic or elliptical-shaped curve defining section 3 does not, of course, have to form a geometrically exact parabola or ellipsoid. It is sufficient if the curve of section 3 generally follows a path resembling a parabola or an ellipsoid. Although preferable, the tip 5 of the lobe does not have to be curved; it can come to a point. Conversely, the curve of tip 5 can be more rounded than that depicted in FIGS. 1 to 3. What is important is that the radius of the parabolic or elliptical-shaped section 3 is sufficient so that a sufficiently large void can be formed without the walls of the filament collapsing and the length of the nipple-shaped section is sufficient to achieve the desired modification ratio.

The line of the profile may have discrete ridges 7 and valleys 8 on a smaller scale, but on a larger scale the line follows a substantially smooth path.

Profile sections 3 and 4 are connected by an intersection 6. The lines of each section 3 and 4 can continue so that they intersect at 6 and form an obtuse angle. Preferably, however, intersection 6 consists of a third concave section 9 as shown in FIGS. 1 to 3.

Another measure of the shape of conventional trilobal filaments in addition to the modification ratio has been the arm angle as shown in FIG. 4 (see U.S. Pat. No. 4,492,731 and Patent No. EP-A-0 516 119). Arm angle is convenient to use because each lobe has essentially straight profiles extending outwardly and tangentially to the inscribed circle. In the case of this invention, however, the composite curved profile 1 is described more accurately with a multiple arm angle measurement. As shown in FIGS. 1 to 3, first arm angle $\alpha$ measures the nipple-shaped section 4 and second arm angle $\beta$ measures the parabolic or elliptical-shaped section 3. Each arm angle is determined by the angle of intersection of the lines drawn along the plane of the portion of each section 3 and 4 that is continuous to the intersection 6 or, in the case of FIGS. 1 to 3 the concave section 9. The first arm angle $\alpha$ ranges from 5° to 30°, preferably 10° to 25°. The second arm angle $\beta$ ranges from 60° to 85°, preferably 70° to 80°. It is apparent that the angles of the first arm angle $\alpha$ and the second arm angle $\beta$ cannot be the same.

About 5 to 15, preferably 10 to 12, percent of the cross-sectional area of the filament of the invention is void. The void area consists of at least one axially extending hole. If one hole is present, it is preferably substantially concentric with the center of the filament cross-section. According to the most preferred embodiment, the void area consists of three axially extending holes 10, with one hole located in each lobe 2. Three smaller holes are preferred over one larger hole, at least when the filaments are intended for use in a cut pile carpet. During production of cut pile carpets the filaments are sheared and the exposed voids must be closed at the end of the filament in order to minimize wicking of soiling and staining materials into the inside of the filament. The holes 10 preferably are located in the parabolic or elliptical-shaped section 3 of each lobe 2 so that a filament wall 11 is formed between the outside surface of the filament and the hole 10.

The holes can vary in shape and size, provided that they are not so large or of a geometric shape which causes the filament walls 11 to be too thin resulting in a tendency for the walls to collapse. Preferably, the holes are substantially round.

In general, the filaments are formed by melt spinning which involves extruding a molten polymer through a spinnerette that has orifices or capillaries which define the size (measured as denier per filament or dpf) and shape of the filament cross-section. In particular, the spinnerette includes a plurality of bore groups. As the molten polymer passes through an individual bore group, an individual filament is formed.

Figure 5:
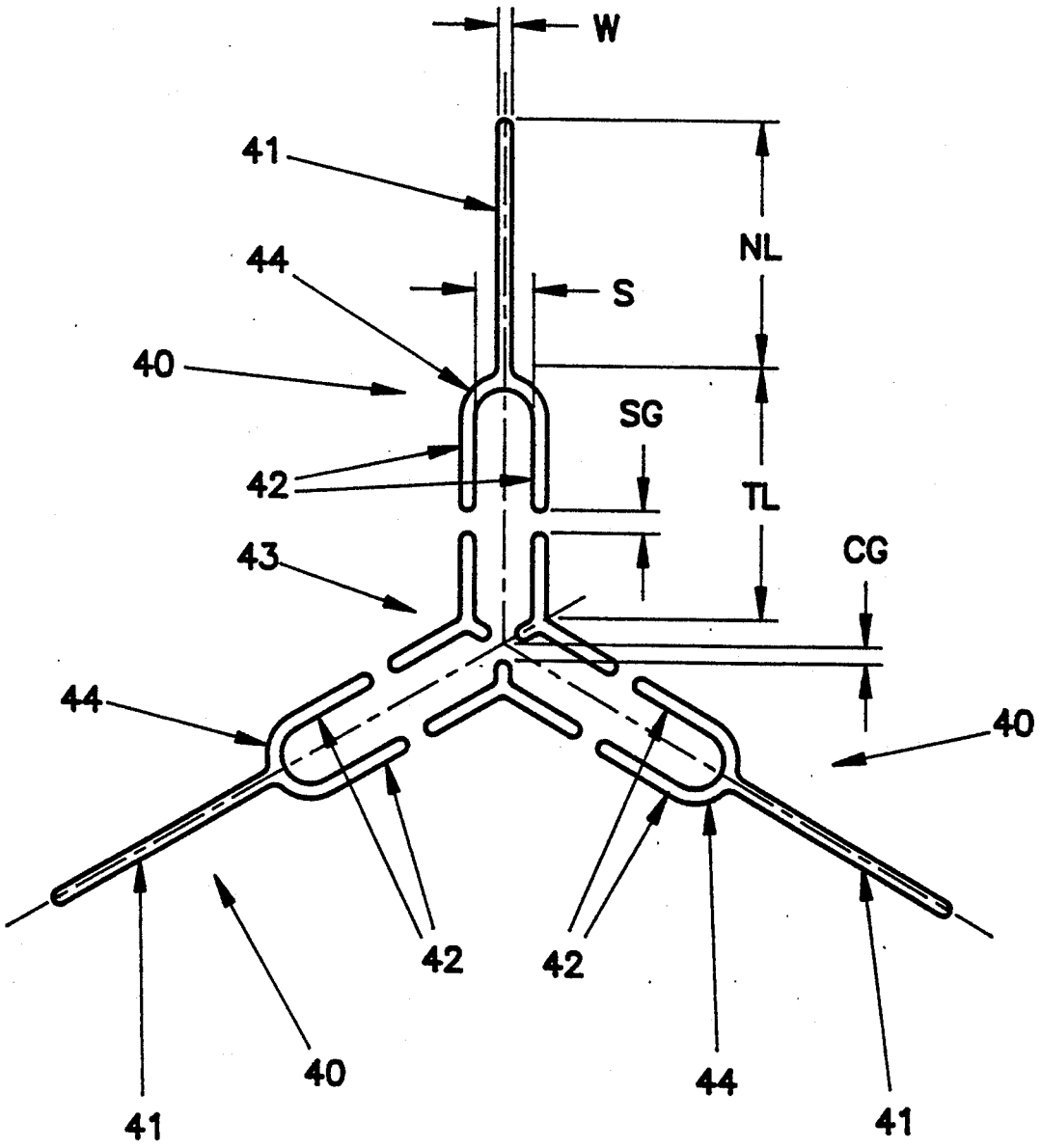
FIGS. 5–7 are cross-sectional views of three different embodiments of spinnerette bore groups used to make the filament of the invention.
Figure 6:
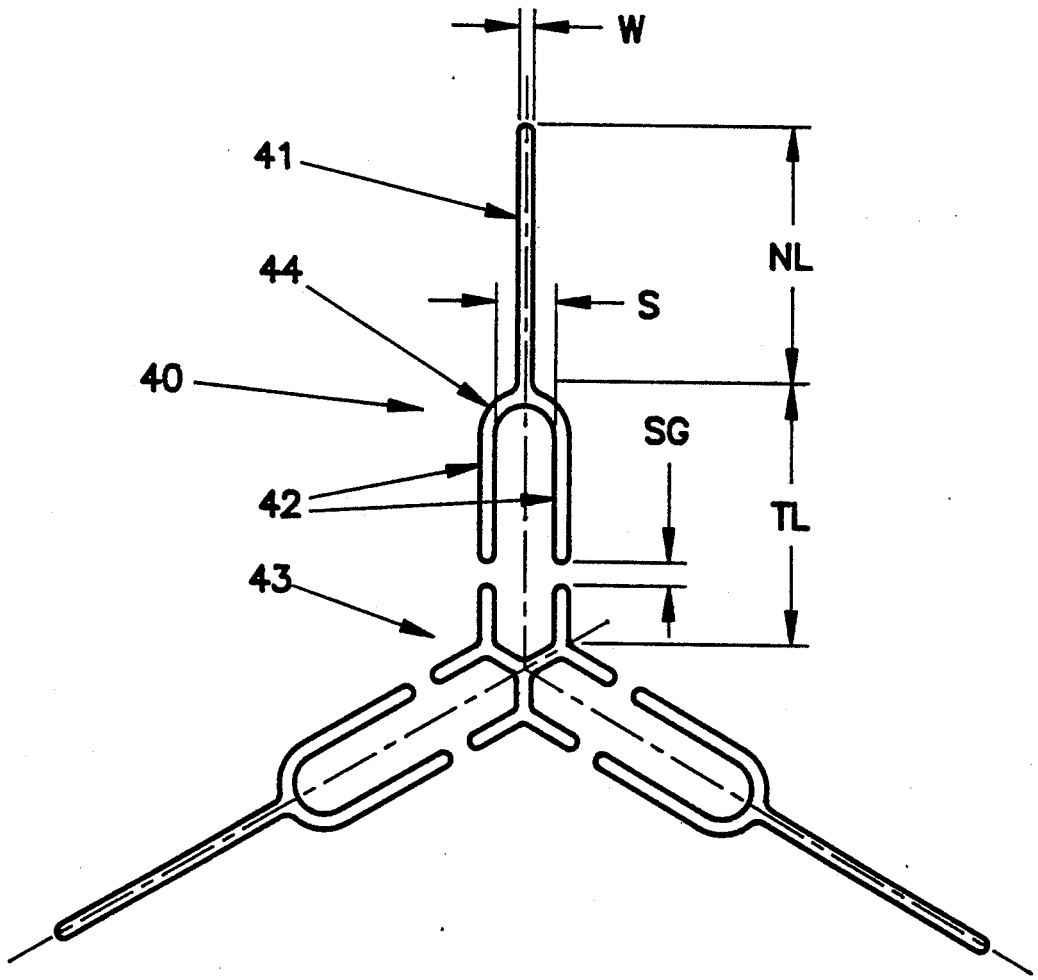
Figure 7:
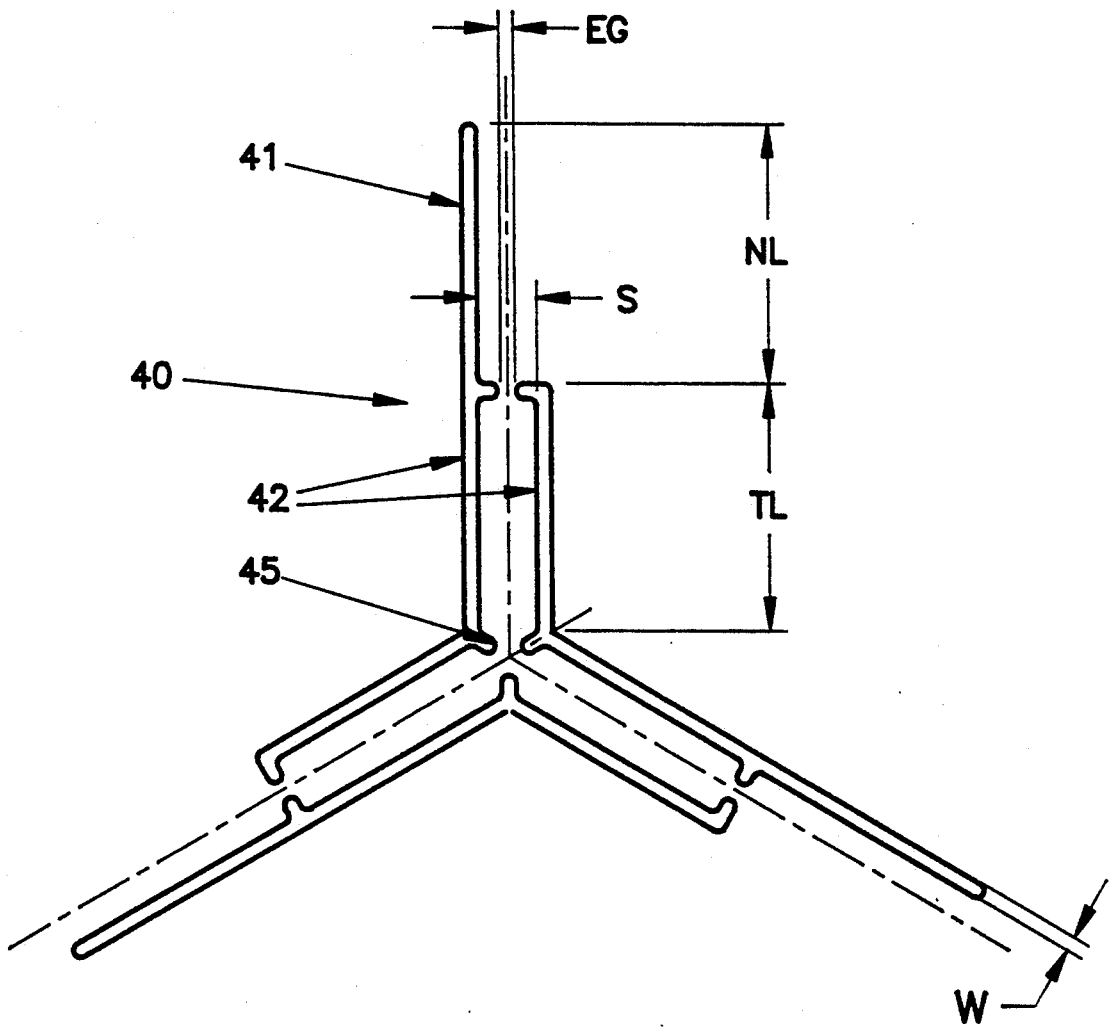

Various spinnerette bore group designs can be used to produce the trilobal filament of the invention. Examples of such designs are illustrated in FIGS. 5 to 7. Each bore group consists of capillaries that are arranged into the general shape of a tripod having three legs 40. Preferably, the legs 40 are arranged so that they are divergent from each other by about 130° to 150°, preferably 120°. Each leg 40 of the tripod functions to form a lobe 2. These examples should not be considered as limiting and any other bore designs which could produce a filament cross-section similar to that described above also could be used.

An important feature in all the designs is the presence in each leg 40 of a single nipple capillary section 41 which extends to the outermost point of each leg 40. The length, NL, of the nipple capillary section 41 should be at least 25 percent of the total length, TL, of the base of the leg 40. Preferably, NL should be at least equal to TL. Each leg 40 also includes two substantially parallel capillary sections 42, which may be connected via a curved capillary section 44. For example, in FIGS. 5 and 6 capillary sections 42 are connected to form, in essence, a single continuous capillary in the shape of an elongated horseshoe. The nipple capillary section 41 is connected to the curved capillary section 44. FIGS. 5 and 6 also include a central capillary group 43.

In a further embodiment, the design shown in FIG. 7 could be modified by extending each of the central protrusions 45 so that they connect at a central point. In such a design, the bore group is a single continuous hole which consists of various capillary sections which are connected.

Any dimensions for the each bore design can be used; however, there a few dimensions common to each design which have been found to be particularly useful. The capillary width, W, should be 0.0020 to 0.0035 inches; the space, S, between the parallel capillaries 42 should be 0.003 to 0.015 inches; the slot or end gaps, SG or EG, should be 0.003 to 0.005 inches; and the central gap, CG, should be 0.002 to 0.003 inches. The total area of the capillaries of the bore group is determined based upon the throughput of extruded material per bore group and preferably ranges between 5.3 to $13.2\times10^4$ $in^2$/l b/hr/bore group. These dimensions can be modified to adjust for the desired modification ratio, void percentage and arm angles.

Figure 14:
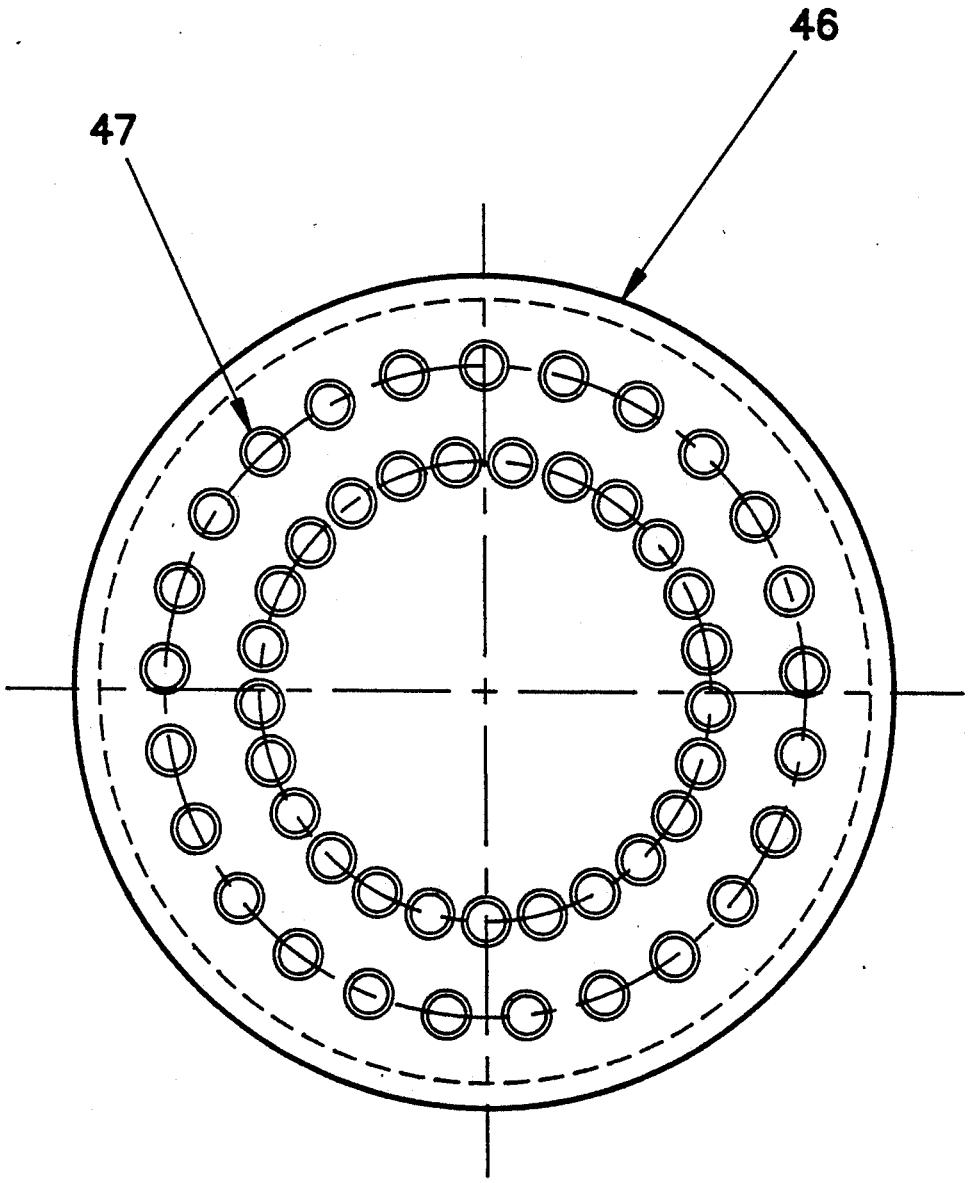
FIG. 14 is a plan view of a spinnerette plate which shows an arrangement of bore groups according to the invention.

The filaments of the invention can be processed into a yarn having any filament count. One method for making a yarn is to extrude the molten polymer through a spinnerette having a plurality of the above-described bore design groups and then have the individual filaments taken up into a package. An example of a spinnerette bore group arrangement is shown in FIG. 14. According to this example, a spinnerette plate 46 is provided with individual bore groups 47 arranged in two concentric circles. This view is from the back of the plate and the capillary designs are on the front of the plate. Preferably, the flow rate of molten polymer through a spinnerette is controlled so that substantially equal volumes of polymer are flowing through each capillary unit of each bore group, such as the three legs 40 and one central capillary group 43 of FIGS. 5 and 6.

Yarns made from filaments of the invention can be processed into face fibers for any type of conventional carpets, especially cut pile, loop pile and combinations thereof. The face fibers of a carpet can consist solely of the filaments of the invention or the filaments can be blended with other types of solid or hollow filaments.

Typically, if filaments of the invention are made from nylon 6, they can be made by metering molten nylon 6 having a melt viscosity of 2000 to 5000 poise at a temperature of 245° to 270° C. through a filter pack and then a spinnerette having a bore group design that depends upon the desired filament cross-section. The extrusion rate is 0.4 to 0.8 lbs/hr/orifice. The extrudate trilobal filaments then are quenched in a conventional chimney either by cross-flow or co-current air flow of about 80 to 150 standard $ft^3$/min, preferably 120 standard $ft^3$/min, at a temperature of about 75° F. and a relative humidity of 65%. If polymers other than nylon 6 are used, these parameters are adjusted accordingly.

Typically, to make a carpet yarn the quenched trilobal filaments are taken up as undrawn yarn at a speed of about 2800 to 3200 ft/min with a dpf of 40 to 80. The undrawn yarns then are drawn and textured by conventional means to produce a 10 to 26 dpf having a % crimp elongation after boil (CEAB) of 15 to 28 and a total yarn bundle denier of 900 to 1800. Single plies of the textured yarn are cable-twisted 3.0×3.0 to 6.0×6.0 twist/inch into a two ply yarn of 1800 to 3600 denier. The twisted yarns are twist-set by either a Superba process at 250–280° F. or a Suessen process at 185°–205 ° C.

In order to illustrate the invention, nylon 6 filament examples were made following the above-described procedure. In each example, the quenched filaments were taken up as undrawn yarn at a speed of 3000 ft/min with a dpf of 75.6, drawn and textured to produce a 25.2 dpf having a CEAB of 16 to 22 and a total yarn bundle of 1260, cable-twisted 3.5×3.5 twist/inch into a two ply yarn of 2700 denier, and twist-set by Superba at 258° F.

To make the carpet the twist-set yarns are tufted on an ⅛ gauge tufter into a Saxony style carpet having a weight of 32 oz/$yd^2$ and 9/16 in. pile height. All the carpet samples were continuously dyed to a "staining beige" (yellow) color.

Figure 8:
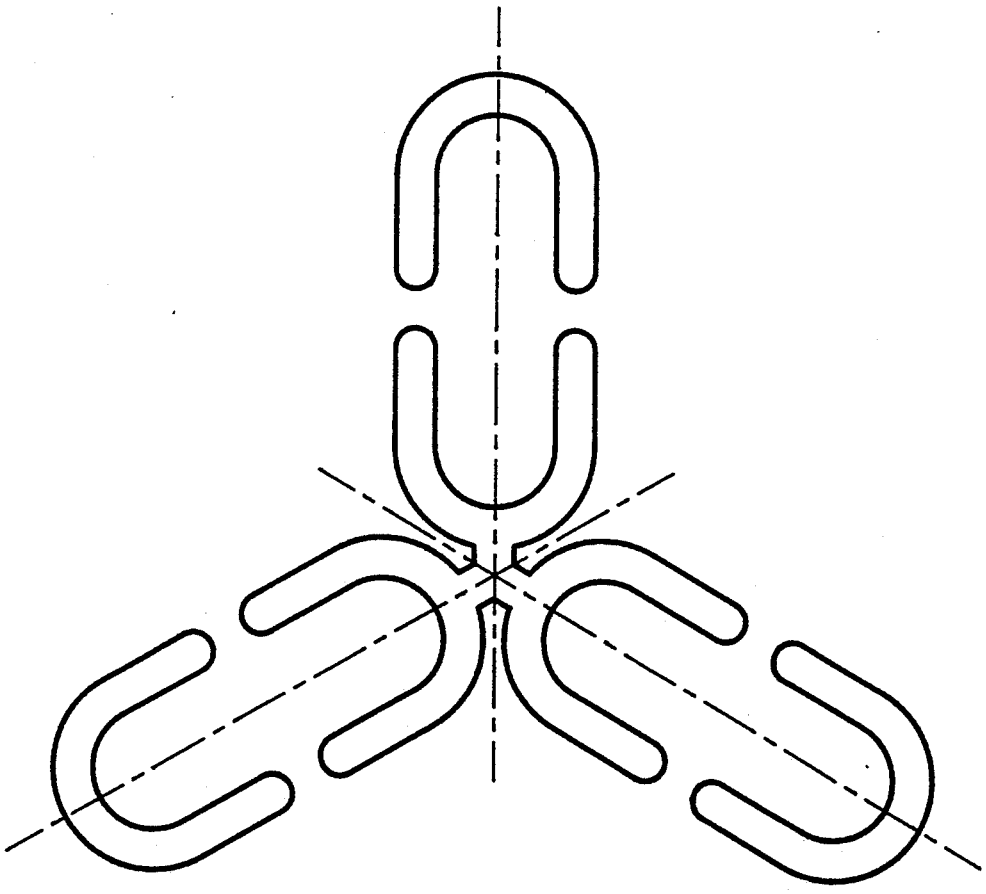
FIGS. 8–9 are cross-sectional views of spinnerette bore groups used to make comparative filaments.
Figure 9:
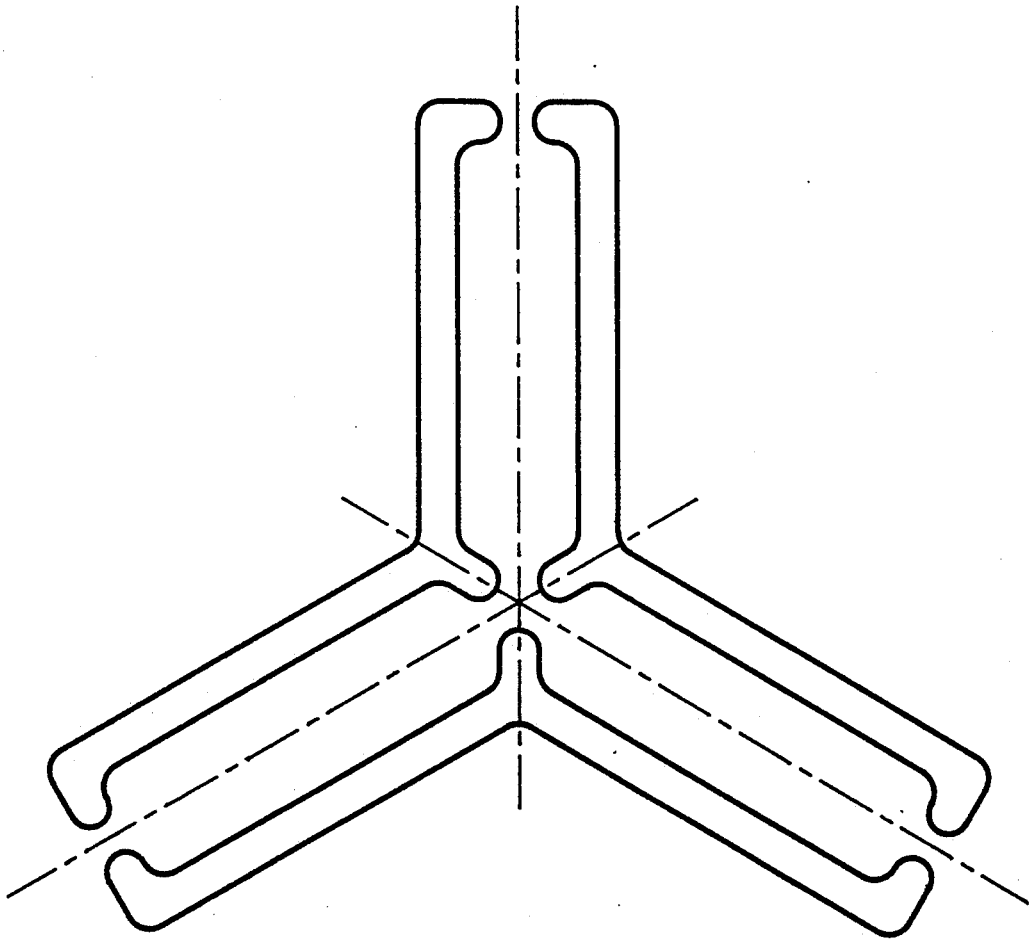

Table 1 shows the filament and carpet characteristics of inventive and comparative examples made according to the above-described procedure. Comparative Examples 1 and 2 are hollow trilobal filaments made with the spinnerette bore group design depicted in FIG. 9. Comparative Example 3 is a hollow trilobal filament made with the spinnerette bore group design depicted in FIG. 8. The lobes of Examples 1 to 3 all have straight profiles as shown in FIG. 4. In other words, the lobes do not have a composite curve profile and, thus, do not have a multiple arm angle measurement. Inventive Examples 4 to 8 were made with the spinnerette bore design group depicted in FIG. 5.

The bulk or carpet body of the carpet samples made from the comparative and inventive examples was measured according to the standard test set forth in Southern et al., "Fundamental Physics of Carpet Performance", *Journal of Allied Polymer Science: Polymer Symposium*, Vol. 47, pp. 361–362 (1991). A higher bulk number indicates that a carpet sample has improved bulk.

Figure 10:
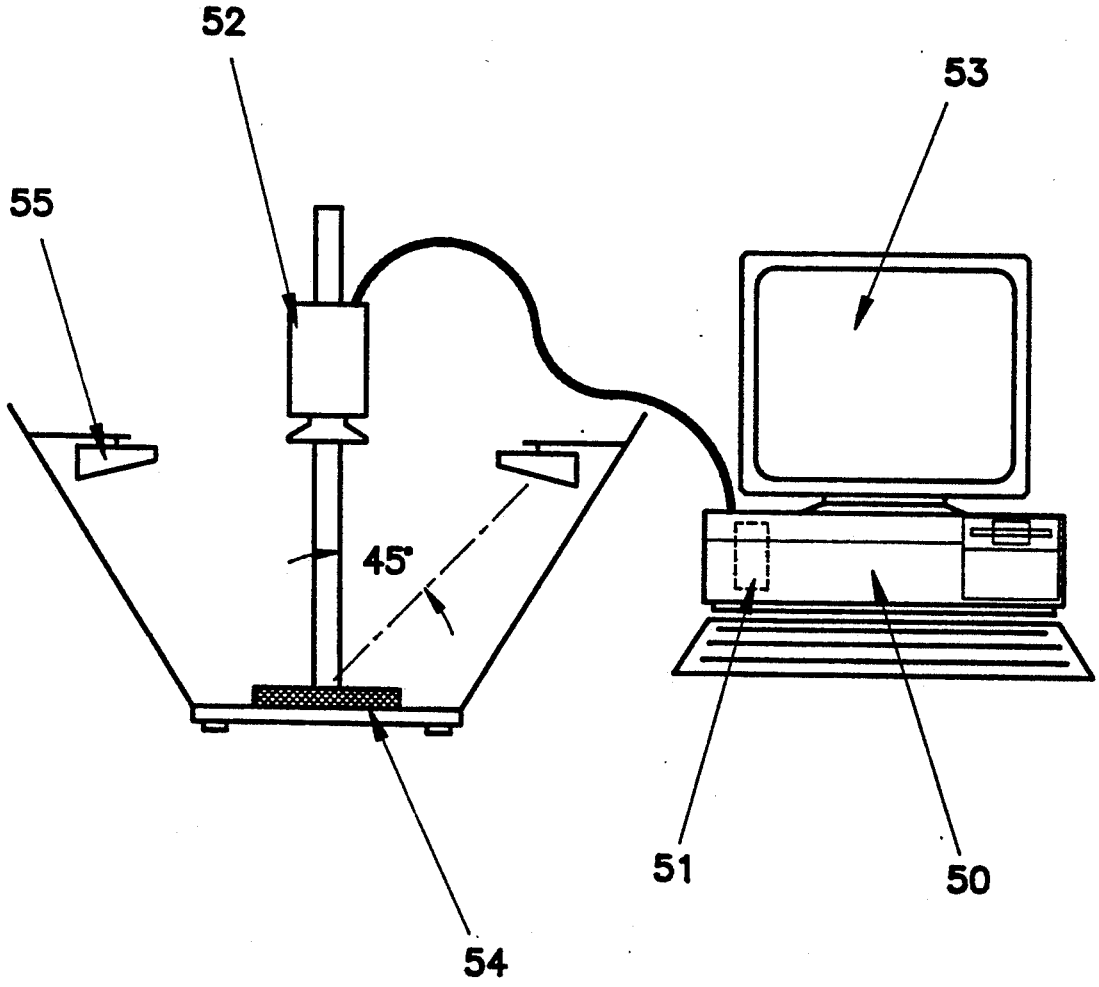
FIG. 10 is a schematic representation of a system used to measure relative luster of carpet samples.

The luster or sparkle was measured using a carpet image analyzer system. This system is illustrated in FIG. 10 and consists of a desktop computer 50, an image grabber board 51 capable of digitizing an image into 256 (horizontal)×200 (vertical) pixels that each have 32 possible levels of red, green and blue, a video camera 52 with zoom and close-up lenses and an analog video monitor 53. A carpet yarn sample 54 was placed on a stand and two fluorescent tubes 55 were arranged in a parallel and symmetrical pattern at an angle of about 45° relative to the sample plane. The carpet yarn samples 54 were prepared by winding yarn on black cardboard to cover an area of about 5×5 inches. The carpet yarn samples 54 were arranged with the filament axis parallel to the light direction.

Figure 11:
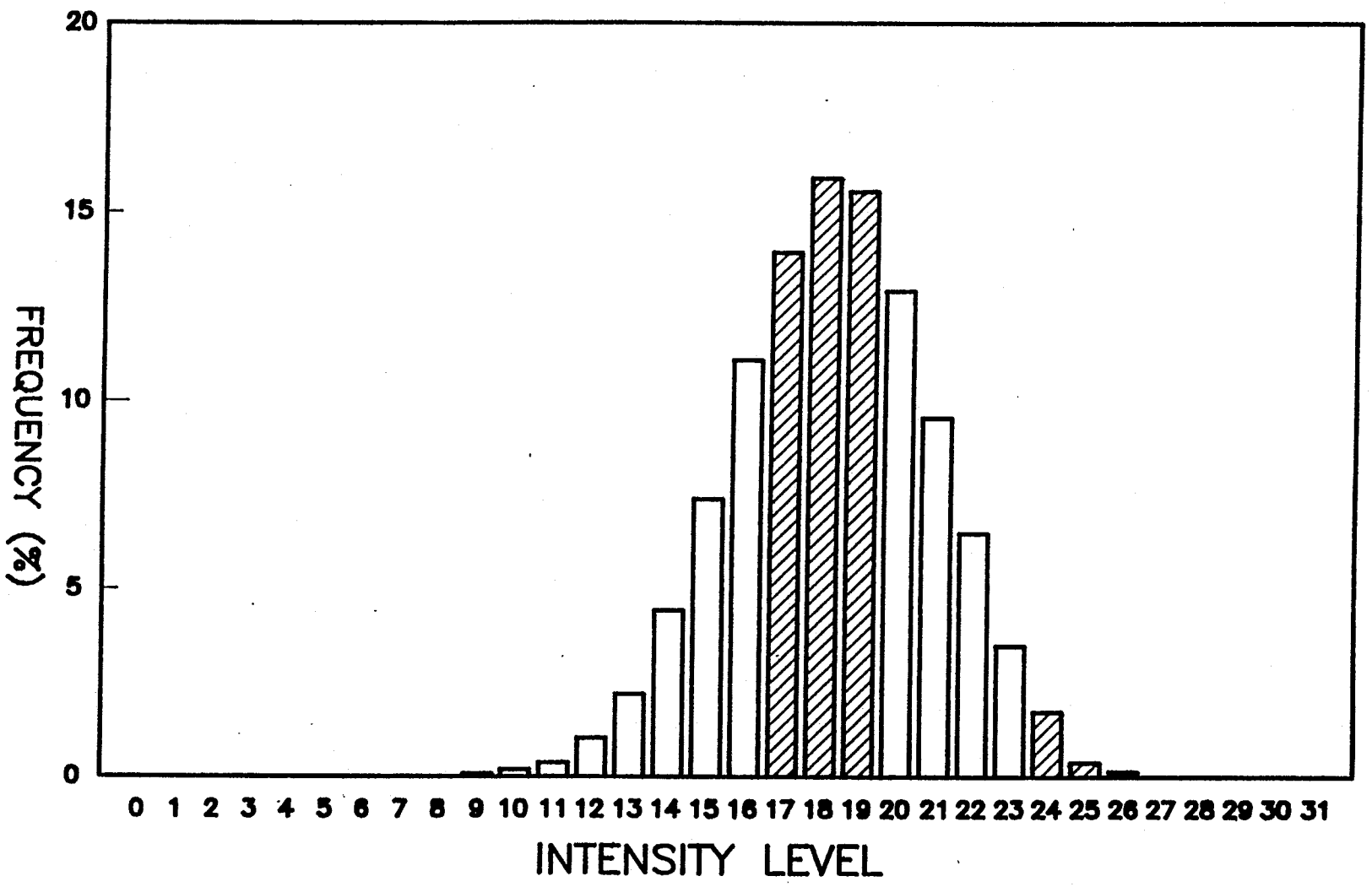
FIG. 11 is a graphic representation of an intensity distribution curve.

The intensity of the reflected light is recorded by the video camera 52 and transmitted to the image grabber board 51 which, in turn, generates an intensity distribution curve, an example of which is shown in FIG. 11. In FIG. 11 the intensity level is measured on a relative scale ranging from 0 to 31 with 0 representing black and 31 representing white. The intensity level is plotted against the frequency or likelihood that a particular pixel will have a certain intensity level. The "luster" of a sample is defined as the difference in intensity between the average intensity of the three highest intensity levels which occur and the average intensity of the middle three intensity levels which center on the most frequently occurring intensity levels. To further reduce electrical noise and variations associated with the digitization, the luster reading was calculated from an averaged image of four frames on the same location of a sample and seven readings were taken for each sample at different locations.

TABLE 1

| Example | Undrawn Yarn Denier | Mod Ratio | % Void | α Angle | β Angle | Drawn Yarn Denier | Bulk (oz/$yd^2$) | Luster |
|---|---|---|---|---|---|---|---|---|
| 1 | 3127 | 1.42 | 12.73 | N/A | N/A | 1149 | 31.5 | 5.6 |
| 2 | 3153 | 1.86 | 16.96 | N/A | N/A | 1161 | 33.1 | 5.3 |
| 3 | 3168 | 2.71 | 11.66 | N/A | N/A | 1144 | 29.0 | 3.4 |
| 4 | 3152 | 2.44 | 6.29 | 24 | 71 | ~1165 | 34.4 | 5.0 |
| 5 | 3155 | 2.77 | 7.62 | 14 | 75 | 1160 | 35.0 | 4.7 |
| 6 | 3141 | 3.61 | 6.93 | 9 | 81 | 1148 | 38.7 | 3.1 |
| 7 | 3142 | 4.09 | 7.69 | 9 | 75 | 1155 | 38.4 | 3.0 |
| 8 | 3162 | 4.50 | 8.90 | 11 | 75 | 1161 | 38.8 | 2.6 |

It is clear from Table 1 that all the carpet samples prepared from inventive Examples 4–8 have improved bulk compared to those prepared from comparative Examples 1–3. The one comparative example (Example 3) that exhibits as low a luster as the inventive examples has very poor bulk.

It has been determined that the composite curve profile or multiple arm arrangement of the filament allows for an increase in the modification ratio. By increasing the modification ratio, a carpet made from the filaments has increased bulk and reduced luster.

Figure 12:
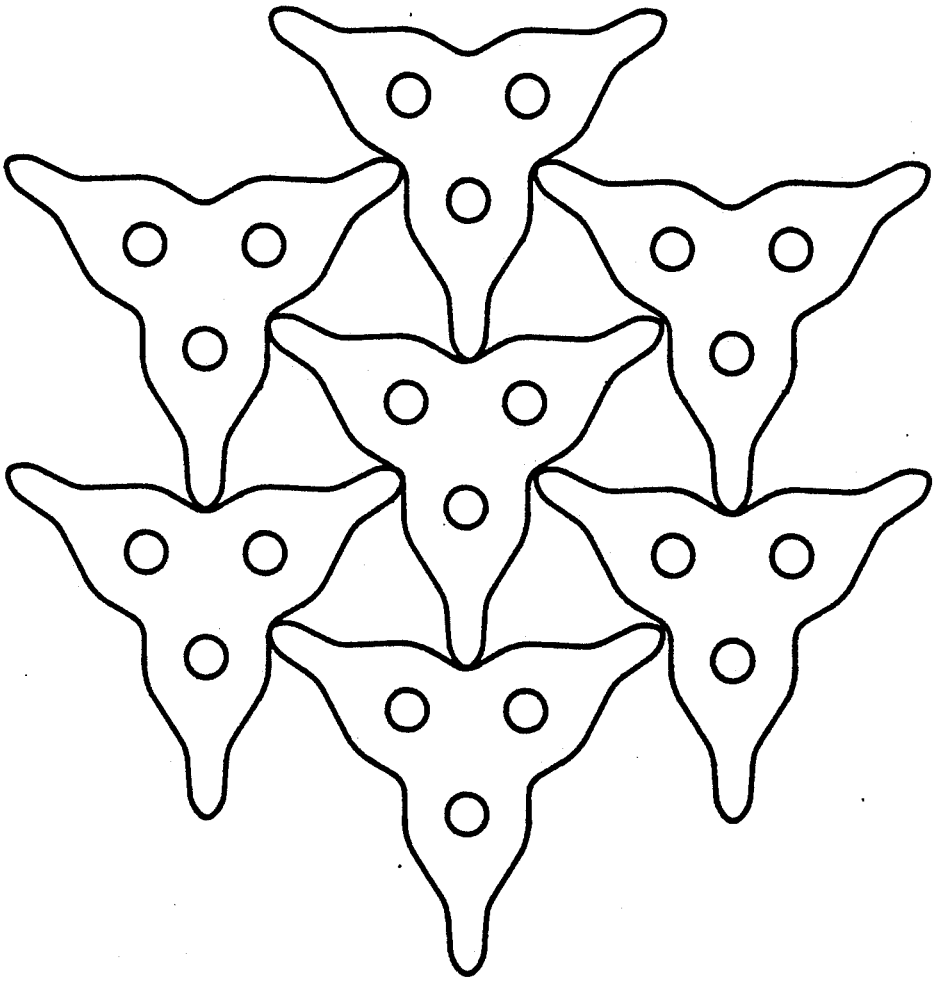
FIG. 12 is a cross-sectional view of filaments of the invention arranged into an approximate circle.
Figure 13:
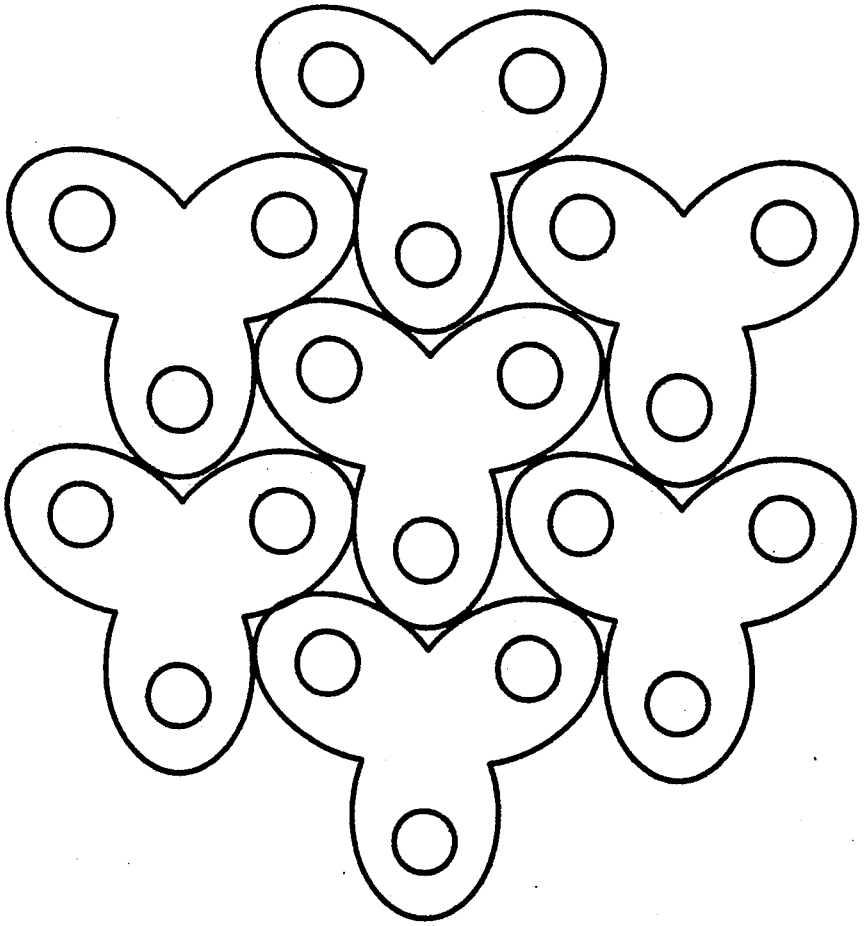
FIG. 13 is a cross-sectional view of comparative filaments arranged into an approximate circle.

The carpet image analyzer system shown in FIG. 10 also was used to determine the degree of coverage offered by the filaments of the invention. FIG. 12 shows seven individual filaments of inventive Example 5 arranged into an approximate circle. FIG. 13 shows seven individual filaments of comparative Example 3 also arranged into an approximate circle. Using the carpet analyzer system, it was determined that in FIG. 12 the total solid filament cross-sectional sectional area (excluding the filament cross-section voids) occupies 379,102.5 pixels and the total cross-sectional area including the solid filament cross-section, the filament void cross-section, and the area separating each individual filament occupies 509,827.5 pixels. In FIG. 13 the total solid filament cross. sectional area occupies 911,250 pixels and the total cross-sectional area occupies 1,113,750 pixels. The coverage coefficient, defined as the ratio of total cross-sectional area to total solid filament cross-sectional area, is 1.345 for FIG. 12 and 1.222 for FIG. 13. It is apparent from these coverage coefficients that in order to cover the same amount of area, the filament of the invention requires a smaller amount of filament polymer than the comparative filament.

From the foregoing description, one skilled in the art can easily ascertain the essential characteristics of this invention, and without departing from the spirit and scope thereof, can make various changes and modifications of the invention to adapt it to various usages and conditions.

We claim:

1. A filament comprising a trilobal cross-section and at least one axially extending void, wherein each lobe has a composite curve profile having a first arm angle $\alpha$ ranging from 5° to 30°, a second arm angle $\beta$ ranging from 60° to 85° and a parabolic or elliptical-shaped section connected to a nipple-shaped section, the cross-section has a modification ratio of 2.4 to 5.0, and the total cross-sectional area is 5 to 15 percent void.

2. A filament according to claim 1, wherein there are three axially extending voids.

3. A filament according to claim 2, wherein there is one axially extending void in each lobe.

4. A filament according to claim 1, wherein the cross-section of the filament has a modification ratio of at least 3.0.

5. A filament according to claim 1, wherein the filament comprises a synthetic material selected from the group consisting of polyamide, polyester, polyolefin and acrylic.

6. A filament according to claim 5, wherein the synthetic material is selected from the group consisting of nylon 6 and nylon 66.

7. A carpet yarn comprising at least one filament having a trilobal cross-section and at least one axially extending void, wherein each lobe has a composite curve profile having a first arm angle $\alpha$ ranging from 5° to 30°, a second arm angle $\beta$ ranging from 60° to 85° and a parabolic or elliptical-shaped section connected to a nipple-shaped section, the cross-section has a modification ratio of 2.4 to 5.0, and the total cross-sectional area is 5 to 15 percent void.

8. A filament according to claim 1, wherein the first arm angle $\alpha$ ranges from 10° to 25° and the second arm angle $\beta$ ranges from 70° to 80°.

9. A carpet yarn according to claim 7, wherein the first arm angle $\alpha$ ranges from 10° to 25° and the second arm angle $\beta$ ranges from 70° to 80°.

* * * * *